US005575328A

United States Patent [19]

Hyp

[11] Patent Number: 5,575,328

[45] Date of Patent: Nov. 19, 1996

[54] DEBRIS BOX

[75] Inventor: Edward J. Hyp, Irwin, Pa.

[73] Assignee: Westinghouse Electric Corporation, Pittsburgh, Pa.

[21] Appl. No.: 287,382

[22] Filed: Aug. 8, 1994

[51] Int. Cl.[6] ..... F28F 27/00

[52] U.S. Cl. ..... 165/11.2; 165/95; 376/249; 376/245; 122/396

[58] Field of Search ..... 165/95, 11.2; 376/260, 376/249, 248, 245; 122/379, 394, 396

[56] References Cited

U.S. PATENT DOCUMENTS

| | | | |
|---|---|---|---|
| H1115 | 12/1992 | Nachbar | 165/11.1 |
| 4,515,747 | 5/1985 | Creek et al. | 376/249 |
| 4,638,667 | 1/1987 | Zimmer et al. | 73/432.1 |
| 4,661,309 | 4/1987 | Hayes | 376/248 |
| 4,702,878 | 10/1987 | Klug et al. | 376/249 |
| 4,760,876 | 8/1988 | Minogue | 165/11.2 |
| 4,848,278 | 7/1989 | Theiss | 122/383 |
| 4,971,140 | 11/1990 | Stoss | 165/95 |
| 5,036,871 | 8/1991 | Ruggieri et al. | 134/167 |
| 5,065,703 | 11/1991 | Lee | 122/382 |
| 5,069,172 | 12/1991 | Shirey et al. | 122/382 |
| 5,088,451 | 2/1992 | Hu et al. | 122/388 |
| 5,194,217 | 3/1993 | St. Louis et al. | 376/316 |
| 5,201,281 | 4/1993 | Cella | 122/382 |
| 5,265,129 | 11/1993 | Brooks et al. | 376/248 |

*Primary Examiner*—John Rivell
*Assistant Examiner*—Christopher Atkinson

[57] ABSTRACT

A debris box, for use with a search and retrieval device for searching and retrieving a plurality of foreign objects within a heat exchanger, includes a holder mechanism, such as a container, for containing the foreign objects which are retrieved by the search and retrieval device within the heat exchanger; and an insertion mechanism, such as a snake, for inserting the holder mechanism into the heat exchanger.

15 Claims, 4 Drawing Sheets

DEBRIS BOX

BACKGROUND OF THE INVENTION

1. Field of the Invention

This invention relates to retrieval of foreign objects from a heat exchanger and more particularly to a debris box for holding a plurality of foreign objects within a nuclear steam generator.

2. Background of Information

In a pressurized water nuclear powered electric generating system, the heat generated by a nuclear reactor is absorbed by a primary coolant that circulates through the reactor core and is utilized to generate steam in a steam generator. The steam generator typically is an upright cylindrical pressure vessel with hemispherical end sections. Such a generator typically comprises an outer vertically oriented shell, a horizontal plate called a tube sheet adjacent to the lower end of the shell, a bundle of vertical U-shaped tubes supported by the tube sheet, and a wrapper barrel inside of the outer shell surrounding the tubes and extending from the upper portion of the shell downwardly to a predetermined point above the tube sheet. The wrapper barrel forms a narrow annulus inside the shell and generally extends down to a point approximately twelve to fourteen inches above the tube sheet. The outer cylindrical shell is provided with one or more openings of limited size called handholes which are typically located about five to twenty-one inches above the tube sheet. These handhole openings are covered during operation of the steam generator but may be opened when the generator is shut down to permit access to the area inside for maintenance purposes.

Occasionally, during maintenance inside the steam generator, objects such as bolts, wires or other foreign objects are inadvertently introduced into the system and have to be removed. Due to the limited space within the generator, the annulus between the wrapper barrel and the shell generally is only about 1.5 to 2.75 inches wide, the space between the shell and the tubes is typically only about 4.5 inches wide, and the space between the bottom of the wrapper barrel and the tube sheet is usually only about twelve to fourteen inches high. The bundle of tubes supported by the tube sheet also are very closely spaced together. Therefore, it is difficult to insert a device into the steam generator annulus. Furthermore, it is difficult to pick up objects between the tubes on the tube sheet.

U.S. Pat. No. 4,702,878, issued Oct. 27, 1987, discloses a device for searching and retrieving foreign objects on the tube sheet of a steam generator. The device includes a probe and a gripper. The probe searches for foreign objects on the surface of the tube sheet and the gripper grasps one of the foreign objects. Whenever a foreign object is retrieved in this manner, the entire device is removed from the steam generator, the foreign object is released from the gripper, and the search and retrieval operation is continually repeated until the entire tube sheet has been inspected and cleaned.

U.S. Pat. No. 4,661,309, issued Apr. 28, 1987, discloses a motorized transporter which searches for foreign objects using a television camera. The transporter retrieves foreign objects with one of a variety of retrieval tools such as a bolt cutter, a retrieval pliers or a rake. The bolt cutter removes a portion of a foreign object which is firmly lodged within the steam generator. The retrieval pliers have plier jaws for grasping and removing a foreign object. The rake moves some of the solid foreign objects which cannot be grasped by the plier jaws. For each removal step, one of the retrieval tools is mounted to the transporter and, then, one or some of the foreign objects are moved to the handhole for removal from the steam generator.

In steam generators which have a single handhole, both the search and retrieval device, which is inserted into the steam generator through the handhole, and the retrieved object or objects must generally be removed from the single handhole. In steam generators which have two or more handholes, the search and retrieval device is inserted through one of the handholes and, then, one, or some, of the foreign objects are removed, a portion at a time, from another handhole. Regardless of the configuration of the steam generator, the removal of one foreign object, or one portion of all of the foreign objects, increases the time to inspect and clean the steam generator. Moreover, inspection personnel for nuclear steam generators are exposed to increased levels of radiation during each removal step from the handhole.

There is a need, therefore, for an apparatus for retrieving foreign objects from a steam generator which reduces the retrieval time for removing the foreign objects from the steam generator.

There is another need for an apparatus for retrieving foreign objects from a steam generator which reduces the radiation dosage received by inspection personnel during the retrieval of the foreign objects from the steam generator.

There is a more particular need for such an apparatus which operates in a steam generator having two handholes.

There is an even more particular need for such an apparatus which operates in a steam generator having a single handhole.

SUMMARY OF THE INVENTION

These and other needs are satisfied by the invention which is directed to a debris box for use with a search and retrieval device which searches and retrieves a plurality of foreign objects within a steam generator. The debris box includes a container for holding the plurality of foreign objects and an insertion mechanism for inserting the container into the steam generator.

The container may include a drawer having an opening for inserting the plurality of foreign objects therethrough and an enclosing mechanism for enclosing the foreign objects within the container. The container may further include a motivating mechanism which cooperates with the enclosing mechanism for opening the container, in order to permit the search and retrieval device to insert the plurality of foreign objects within the container, and for closing the container, in order to enclose or hold the foreign objects within the container.

The enclosing mechanism may be an elongated housing which at least partially blocks the drawer. The elongated housing may have an open end and a closed end having a hole. The motivating mechanism may be attached to the elongated housing and include a rod which passes through the hole of the closed end of the elongated housing. The rod may be attached to the drawer for moving the drawer between a closed position and an open position. The elongated housing may substantially cover the opening of the drawer in the closed position and at least partially uncover the opening of the drawer in the open position. The motivating mechanism may include a double acting pneumatic cylinder for pushing and pulling the rod, a first air line which is selectively pressurized by a first remote valve for energizing the pneumatic cylinder in order to push the rod and open the drawer, and a second air line which is selectively pressurized by a second remote valve for reverse energizing the pneumatic cylinder in order to pull the rod and close the drawer.

The container may be a closable container which holds the plurality of foreign objects and which has a closable opening for enclosing the foreign objects within the closable container. The closable container may include a holder having an opening for inserting the plurality of foreign objects therethrough, an elongated barrier which telescopes with the holder, and a motivating mechanism for telescoping the holder and the elongated barrier between a closed position and an open position. The elongated barrier may substantially block the opening of the holder in the closed position and at least partially reveal the opening of the holder in the open position. The elongated barrier may be a generally cylindrical tube and the holder may be a generally cylindrical holder. The generally cylindrical tube may substantially close the opening of the generally cylindrical holder in the closed position, in order to grasp one of the plurality of foreign objects between the generally cylindrical tube and the generally cylindrical holder.

Alternatively, the container may be a magnetic container for magnetically holding a plurality of magnetically attractable foreign objects. The magnetic container may include a moving mechanism for moving the magnetic container within the steam generator. The magnetic container may also include a magnetic inner surface for magnetically attracting the magnetically attractable foreign objects and a non-magnetic outer surface for movement on the tube sheet. The magnetic inner surface may include a plurality of magnets. Alternatively, the magnetic inner surface may include an electromagnet which is remotely energized, in order to selectively attract and hold the magnetically attractable foreign objects.

The insertion mechanism may include a guide tube for guiding the container between the handhole and the tube sheet of the steam generator. The insertion mechanism may further include a moving mechanism for moving the container through the guide tube. The moving mechanism may include a snake attached to the motivating mechanism for remotely pushing and pulling the container. Alternatively, the moving mechanism may be a line or wire attached between the handhole and the magnetic container for lowering the magnetic container into the annulus, in order to collect the plurality of magnetically attractable foreign objects which are held by the magnetic container, and for pulling the magnetic container from the annulus, in order to remove the magnetic container and the magnetically attractable foreign objects from the steam generator without human entry therein.

BRIEF DESCRIPTION OF THE DRAWINGS

A full understanding of the invention can be gained from the following description of the preferred embodiment when read in conjunction with the accompanying drawings in which.

DESCRIPTION OF THE PREFERRED EMBODIMENT

Figure 1:
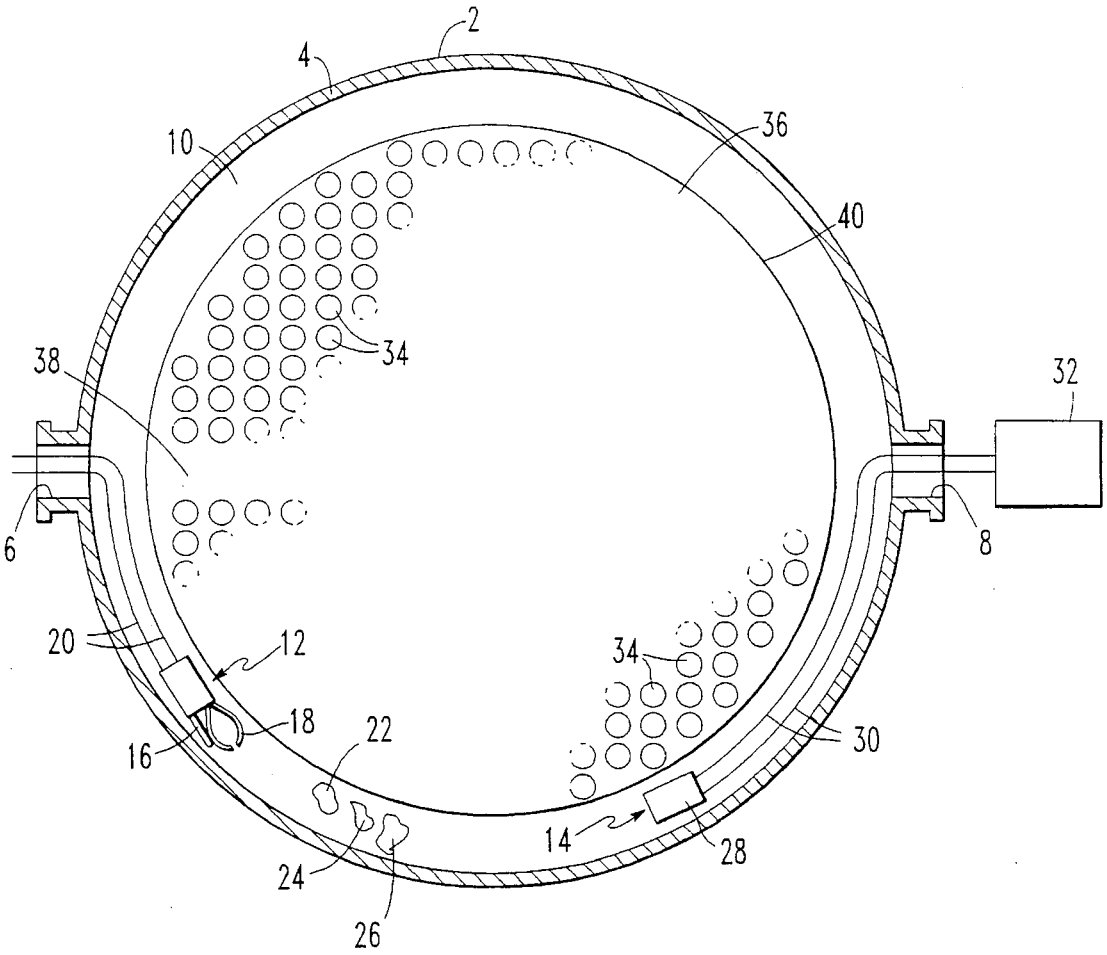
FIG. 1 is a sectioned plan view of a conventional nuclear steam generator having two handhole openings, a search and retrieval device, and a debris box in accordance with the invention.

Referring to FIG. 1, a sectioned plan view of a conventional nuclear steam generator 2 is illustrated, it being understood that the invention is applicable to a variety of heat exchangers, such as fossil steam generators or reheaters. The steam generator 2 includes an outer cylindrical shell 4 and two openings 6,8 which are generally referred to as handholes. Immediately inside the shell 4 is an annulus 10. A search and retrieval device 12 and a debris box 14 are located within the boundary of the annulus 10. A non-limiting example of a search and retrieval device is disclosed in U.S. Pat. No. 4,702,878, issued Oct. 27, 1987, which is herein incorporated by reference, it being understood that the present invention is applicable to a variety of manual, automatic, and robotic search and retrieval devices.

The exemplary search and retrieval device 12 includes an inspection probe 16 (e.g., a fiberscope, a video probe, a miniature television camera, etc.), a gripper 18, and control cables 20. The gripper 18 is suitable for picking up or otherwise moving one or some of a plurality of foreign objects 22,24,26 within the steam generator 2. The control cables 20 extend through the handhole 6 and interconnect the search and retrieval device 12 with an inspector (not shown) and/or an inspection processor (not shown). As described in greater detail below, the debris box 14 includes a holder 28 for holding the foreign objects 22,24,26 and control cables 30. The control cables 30 extend through the handhole 8 and interconnect the debris box 14 with an inspector (not shown) and/or a control device 32, such as an actuator, a manual or automatic positioning device, and/or an inspection processor.

Figure 2:
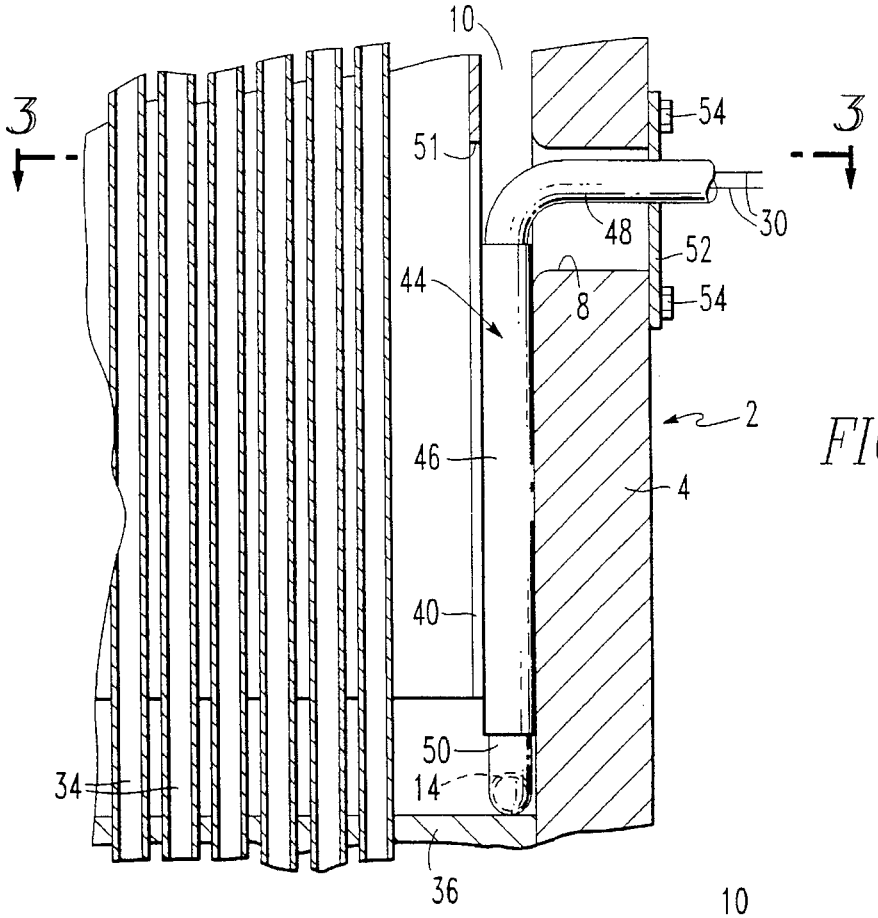
FIG. 2 is a fractional vertical sectional view of a lower portion of the shell of a conventional nuclear steam generator showing a guide tube extending through a handhole opening down to the periphery of the tube sheet, and a debris box in accordance with the invention.
Figure 3:
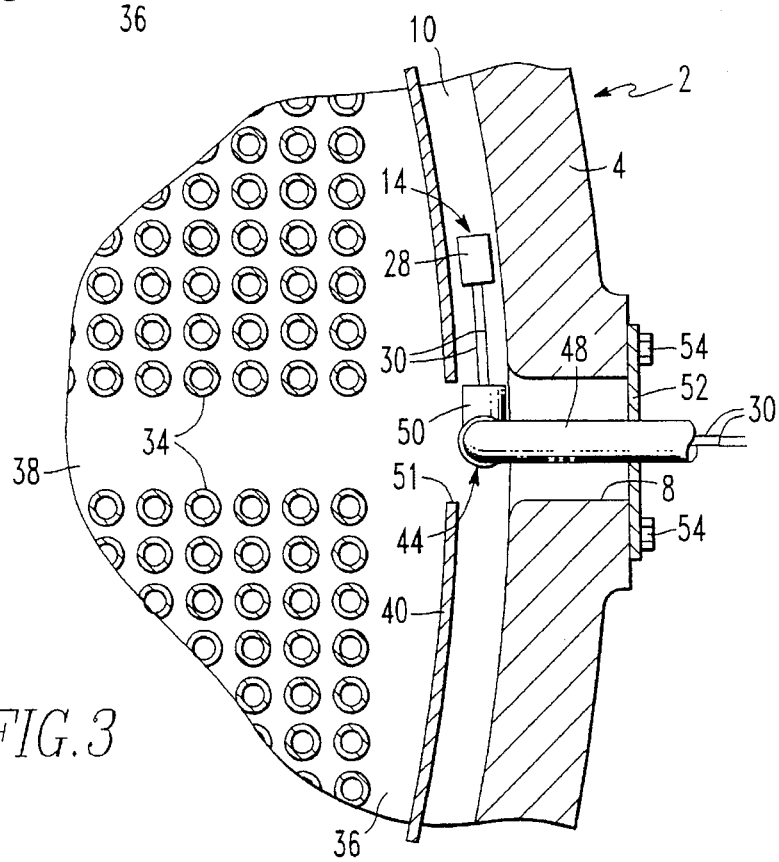
FIG. 3 is a fractional horizontal sectional view, taken along line 3—3 of FIG. 2, showing a top view of the debris box in accordance with the invention in position at the periphery of the tube sheet.

Referring to FIGS. 1, 2 and 3, the steam generator 2 further includes a plurality of closely spaced vertical tubes 34 supported by and extending upwardly from a tube sheet 36. The vertical tubes 34 are associated by pairs with a U-bend at the top (not shown) so as to straddle two sides of an aisle or tube lane 38, as shown in FIG. 3, extending centrally across the shell 4. In the exemplary embodiment, the tubes 34 are surrounded by a wrapper barrel 40 spaced approximately two inches from the interior wall of the shell 4 to form the annulus 10, therewith. As shown in FIG. 2, the exemplary wrapper barrel 40 and, consequently, the annulus 10, extend downwardly to a point which is approximately thirteen inches above the tube sheet 36.

Continuing to refer to FIGS. 2 and 3, a guide tube 44 has a straight main segment 46 and an L-shaped upper segment 48 which is bent at a right angle with respect to the main segment 46. The guide tube 44 further includes an L-shaped lower segment 50 which is also bent at a right angle with respect to the main segment 46. The lower segment 50 extends in a direction rotated 90° from the direction of the upper segment 48. In this manner, a plane of the upper segment 48 is generally perpendicular to a plane of the lower segment 50. The lower segment 50 of the guide tube 44 rests on and is parallel to the surface of the tube sheet 36.

The upper segment 48 and the lower segment 50 may be constructed as separate parts from the main segment 46 of the guide tube 44 to facilitate insertion of the guide tube 44 into the steam generator 2. Also, the wrapper barrel 40 may have a cutout 51 at the end of the aisle 38 and adjacent to the main segment 46. This cutout 51 also facilitates insertion of the guide tube 44 into the steam generator 2. The exemplary guide tube 44 is secured at its upper end to the shell 4 at handhole 8 by a guide plate 52 which is fastened to the shell 4 by a plurality of bolts 54. Alternatively, the guide tube 44 may be unsecured at its upper end. The guide tube 44 may be utilized to guide the holder 28 (see FIG. 1) of the debris box 14 between the handhole 8 and the tube sheet 36.

Figure 4:
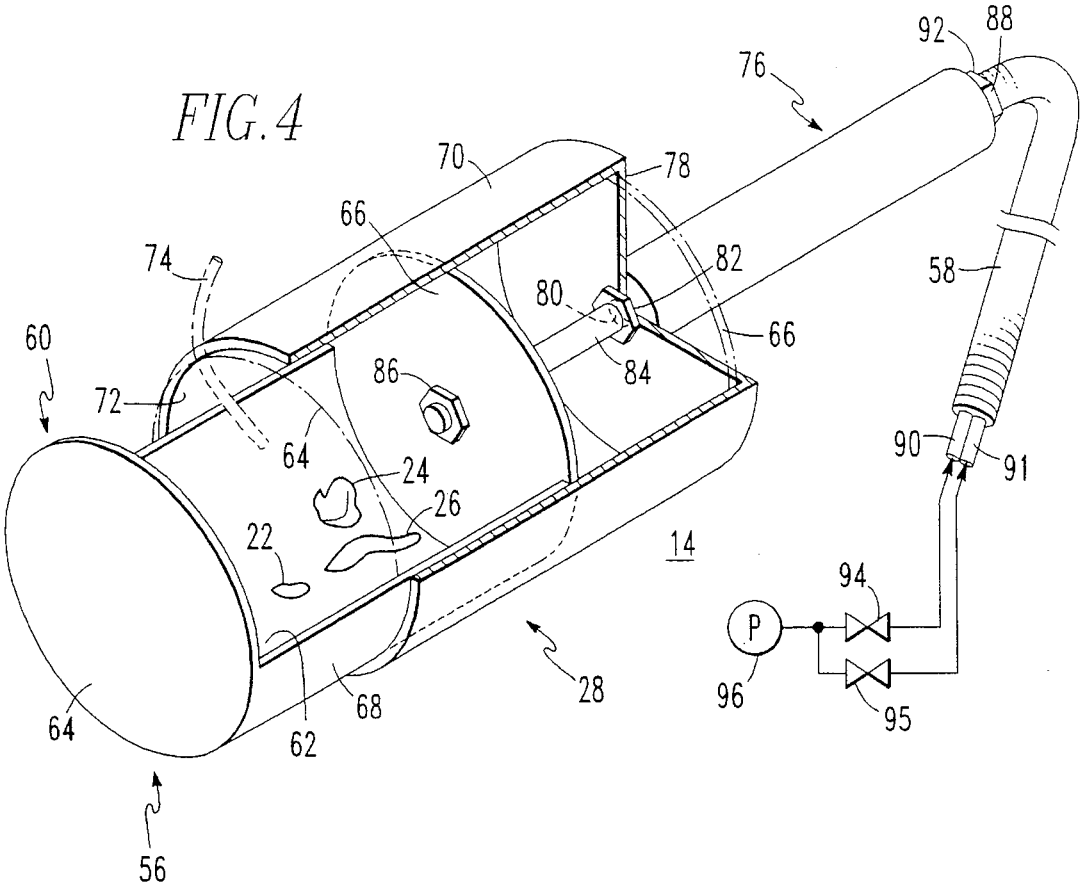
FIG. 4 is a cut-away isometric view of an embodiment of a debris box in accordance with the invention.

Referring to FIG. 4, a cut-away isometric view of the debris box 14 is illustrated. The debris box 14 includes a container 56 for holding the foreign objects 22,24,26 and a snake 58 (e.g., a plumbers-type snake, a conduit, a cable, etc.) for inserting and moving the container 56 within the boundary of the annulus 10 of the steam generator 2 (see FIG. 1). The container 56 may be formed from a variety of materials such as stainless steel, aluminum or nylon. The container 56 includes a drawer 60 having an opening 62 for inserting the foreign objects 22,24,26 therethrough. The exemplary drawer 60 is formed as a generally cylindrical holder having two circular ends 64,66 disposed at the ends of a half-cylinder holder 68. The opening 62 is formed between the ends 64,66 and above the half-cylinder holder 68. The container 56 also includes an elongated barrier or housing 70. The housing 70 is formed as a generally cylindrical tube which includes an open end 72.

In the open position of FIG. 4, the holder 68 is partially removed from the housing 70, in order that the opening 62 of the holder 68 is exposed. In the closed position (shown in shadow in FIG. 4), the holder 68 is inserted into the housing 70 which substantially covers the opening 62. In this manner, the debris box 14 may be used to hold the foreign objects 22,24,26 in the bottom of the holder 68. Furthermore, the end 64 of the holder 68 and the housing 70 may be used to grasp a foreign object, such as the exemplary wire 74 (shown in shadow in FIG. 4), between the end 64 and the housing 70. Alternatively, any relatively long foreign object, such as a weld rod or tie wrap, may be partially inserted into the opening 62 and captured by the closure of the housing 70. In this manner, a variety of objects, which may be smaller or larger than the opening 62 may be captured and/or held by the debris box 14.

The container 56 further includes a motivating device, such as the exemplary double acting pneumatic cylinder 76, which cooperates with the housing 70 for opening the container 56, in order to permit the search and retrieval device 12 of FIG. 1 to insert the foreign objects 22,24,26 within the opening 62 of the holder 68 of the container 56, and for closing the container 56, in order to enclose the foreign objects 22,24,26 within the container 56. In this manner, the foreign objects 22,24,26 are inserted through the opening 62 and the container 56 is closed, in order to hold the foreign objects 22,24,26 therein. Those skilled in the art will appreciate that other equivalent embodiments of the container 56 are possible which, like the exemplary embodiment, include a barrier which telescopes with a holder. Those skilled in the art will further appreciate that other equivalent embodiments of the cylinder 76 are possible, such as a single action, spring loaded cylinder.

The elongated housing 70 includes a closed end 78 having a hole 80 (shown in shadow). One end of the pneumatic cylinder 76 is attached to the housing 70 by a fastener 82. The pneumatic cylinder 76 includes a rod 84 which passes through the hole 80 of the closed end 78 of the housing 70. The rod 84 is attached to the drawer 60 by a fastener 86. The other end of the pneumatic cylinder 76 is attached to the snake 58 by a fastener 88, such as the exemplary hex nut, or by a swage connection (not shown). The snake 58 permits an inspector to insert the container 56 into the guide tube 44 of FIG. 2 and, then, move the container 56 through the guide tube 44 and within the boundary of the annulus 10. In this manner, the inspector may remotely, with respect to the interior of the steam generator 2 of FIG. 2, manipulate the snake 58, in order to remotely push and pull the container 56 within the steam generator 2.

Two air hoses or air lines 90,91 pass through the snake 58. Alternatively, the air lines 90,91 may be fastened to the exterior of the snake 58 by tie wraps (not shown) or tape (not shown). The air lines 90,91 are interconnected at one end with the pneumatic cylinder 76 at connection 92. Two remote air actuating levers or valves 94,95 are connected to the other ends of the air lines 90,91 and selectively interconnect the air lines 90,91, respectively, with a source of air pressure 96. Whenever the valve 94 is open and the valve 95 is closed, the air pressure source 96 energizes one-half of the double acting pneumatic cylinder 76. In turn, the rod 84 of the pneumatic cylinder 76 partially pushes the drawer 60 out of the housing 70, in order to reveal the opening 62 and, thus, open the drawer 60. On the other hand, whenever the valve 95 is open and the valve 94 is closed, the other half of the double acting pneumatic cylinder 76 is energized. Then, the rod 84 of the pneumatic cylinder 76 pulls the drawer 60 within the housing 70, in order to cover the opening 62 and, hence, close the drawer 60. In this manner, the housing 70 substantially covers or blocks the opening 62 of the drawer 60 in the closed position and at least partially uncovers or opens the opening 62 of the drawer 60 in the open position.

Referring to FIGS. 1, 2 and 4, whenever an inspector uses the debris box 14, the holder 28 is initially inserted through the end of the upper segment 48. The holder 28 and the control cables 30 are then inserted through the handhole 8 until the holder 28 is positioned on the surface of the tube sheet 36 via the lower segment 50 which is parallel to the surface of the tube sheet 36. In this manner, the plane of the steam generator 2 need not be broken. Thus, the inspector is not exposed to excessive radiation. Furthermore, the debris box 14 may be conveniently "parked" at the 90° point between the handholes 6,8 for access by the search and retrieval device 12. Those skilled in the art will appreciate that the debris box 14 may also be moved within the steam generator 2 by a variety of manual and automatic positioning devices (not shown).

Figure 5:
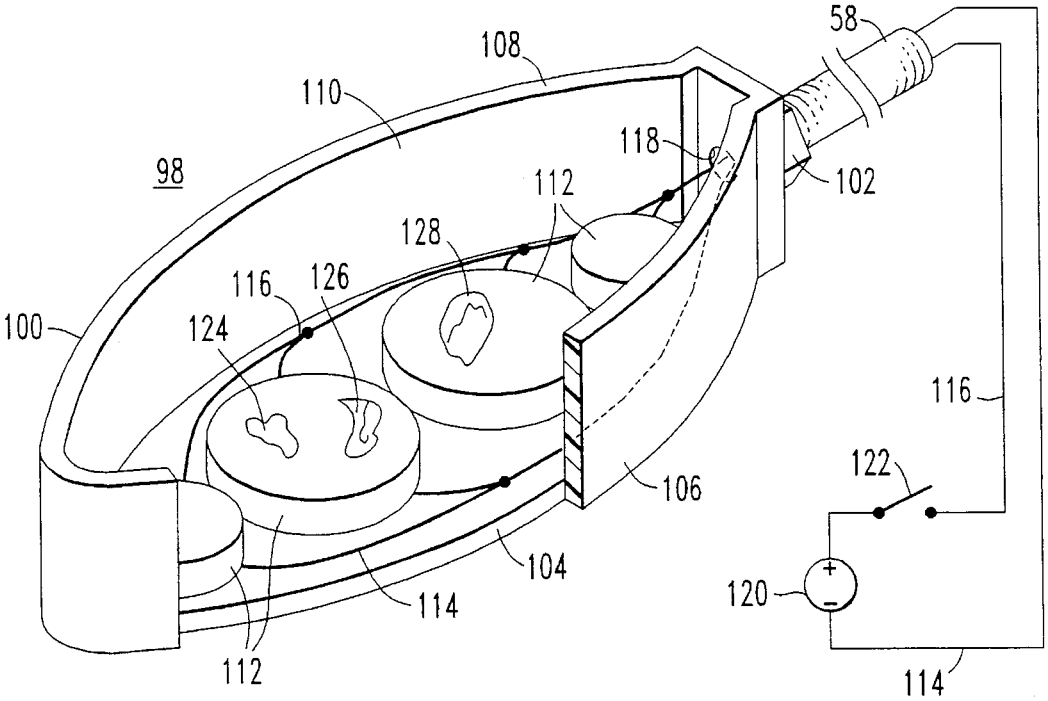
FIG. 5 is a cut-away isometric view of an alternative embodiment of a debris box in accordance with the invention.

FIG. 5 is a cut-away isometric view of an alternative embodiment of a magnetic debris box 98 which includes a boat-shaped container 100 and a snake 58. The snake 58, which has the same function as described above with FIG. 4, is attached to an end of the container 100 by a suitable fastener 102. The exemplary container 100 has a bottom 104, two arcuate sides 106,108, and an open face 110. The bottom 104 and the two sides 106,108 have a sufficient non-magnetic thickness which allows slidable movement of the debris box 98 along the tube sheet 36 or within the annulus 10 of FIG. 1. In the exemplary embodiment, the bottom 104 and sides 106, 108 are made of a suitable thickness of non-magnetically attractable material, such as 0.125 inch thick nylon.

Inside the container 100, between the bottom 104 and the open face 110, are a plurality of electromagnets 112. The electromagnets 112 are electrically connected in parallel by two wires 114,116 which exit through a hole 118 (shown in shadow) in the container 100. The wires 114,116 pass through the snake 58. Alternatively, the wires 114, 116 may be fastened to the exterior of the snake 58 by tie wraps (not shown) or tape (not shown). In turn, the wire 114 is connected to one terminal of a suitable power supply 120, such as the exemplary +24 VDC power supply. The other terminal of the power supply 120 is connected to one terminal of a switch 122. The other terminal of the switch 122 is connected to the wire 116.

Whenever the switch 122 is closed, the power supply 120 energizes the electromagnets 112 and a plurality of magnetically attractable foreign objects 124,126,128, which are retrieved by the search and retrieval device 12 within the steam generator 2 of FIG. 1, are magnetically held within the magnetic debris box 98. In this manner, the magnetic debris box 98 includes a non-magnetic outer surface formed by the bottom 104 and two sides 106,108 for movement on the tube sheet 36 or within the annulus 10 of FIG. 1 and, also, includes a magnetic inner surface formed by the electromagnets 112 for magnetically attracting the magnetically attractable foreign objects 124,126,128. Furthermore, the switch 122 may be used to remotely energize the electromagnets 112, in order to selectively attract and hold the objects 124,126,128. Alternatively, the debris box 98 may include a plurality of ceramic magnets (not shown) as described in greater detail with FIG. 6, below.

Figure 6:
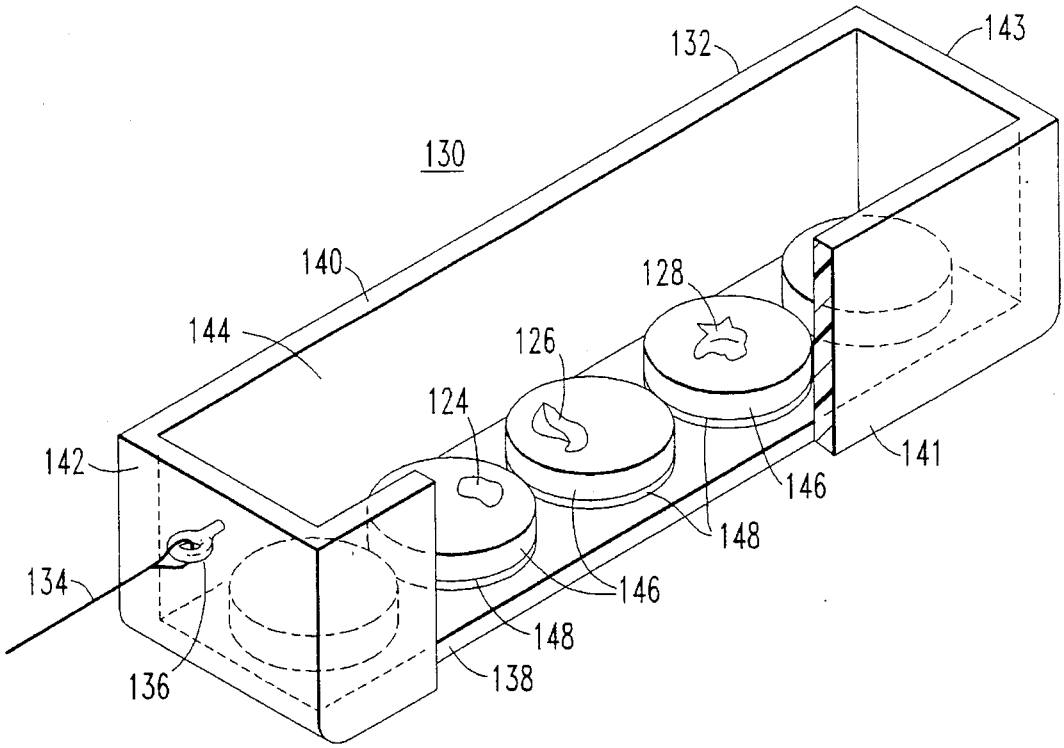
FIG. 6 is a cut-away isometric view of another alternative embodiment of a debris box in accordance with the invention.

Referring to FIG. 6, a cut-away isometric view of another alternative embodiment of a debris box 130 is illustrated. The exemplary debris box 130 includes a rectangular-shaped container 132 and a line 134. The exemplary line 134, such as a nylon rope or a wire, is attached to an end of the container 132 by a suitable fastener 136. The container 132 has a bottom 138, two sides 140,141, two ends 142,143, and an open face 144. The bottom 138, sides 140,141, and ends 142,143 have a sufficient non-magnetic thickness, which allows slidable movement of the debris box 130 along the tube sheet 36 or within the annulus 10 of FIG. 1, and are made of the same material as described above with the bottom 104 and sides 106,108 of FIG. 5.

Inside the container 132, between the bottom 138 and the open face 144, are a plurality of magnets 146. The magnets 146 are secured to the bottom 138 using a suitable fastener 148, such as epoxy. The exemplary ceramic magnets 146 have a pull-strength of 30 pounds and are made of a barium-iron oxide or a strontium-iron oxide, although any suitable pull-strength or magnetic material is acceptable. In this manner, the magnetic debris box 130 includes a non-magnetic outer surface formed by the bottom 138, sides 140,141, and ends 142,143 for movement on the tube sheet 36 or within the annulus 10 of FIG. 1 and, also, includes a magnetic inner surface formed by the magnets 146 for magnetically attracting the magnetically attractable foreign objects 124,126,128.

The line 134 may be attached between the container 132 and the handhole 6 of the steam generator 2 of FIG. 1. Then, the debris box 130 may be inserted through the handhole 6 and lowered into a position which is readily accessible by the search and retrieval device 12 of FIG. 1. This device 12 collects the magnetically attractable foreign objects 124, 126,128 and deposits such objects into the magnetic debris box 130. In this manner, any fixture, such as the guide plate 52 of FIG. 2, may be conveniently fastened to the shell 4 over the line 134 without obstruction or damage. Later, after all of the magnetically attractable foreign objects 124,126, 128 have been retrieved from the steam generator 2, the debris box 130 and the objects 124,126,128, which are held by the magnets 146, may be removed from the steam generator 2 by pulling the debris box 130 by the line 134. Accordingly, this embodiment of the invention is preferred for use in a steam generator 2 having a single handhole 6.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed:

1. An apparatus for use with a search and retrieval device for searching and retrieving a plurality of foreign objects within a heat exchanger, said apparatus comprising:

container means for containing said plurality of foreign objects which are retrieved by said search and retrieval device within said heat exchanger; and insertion means for inserting said container means into said heat exchanger.

2. The apparatus as recited in claim 1, wherein said container means includes a drawer means having an opening for inserting said plurality of foreign objects therethrough.

3. The apparatus as recited in claim 1, wherein said heat exchanger also has a handhole and a tube sheet, and wherein said insertion means includes guide means between the handhole and the tube sheet for guiding said container means between the handhole and the tube sheet.

4. The apparatus as recited in claim 3, wherein said insertion means further includes moving means for moving said container means through said guide means and on the tube sheet.

5. The apparatus as recited in claim 4, wherein said moving means includes means for remotely pushing and pulling said container means.

6. The apparatus as recited in claim 1, wherein said container means includes enclosing means for enclosing said plurality of foreign objects within said container means.

7. The apparatus as recited in claim 6, wherein said container means further includes motivating means cooperating with said enclosing means for opening said container means, in order to permit said search and retrieval device to insert said plurality of foreign objects within said container means, and for closing said container means, in order to enclose said plurality of foreign objects within said container means.

8. The apparatus as recited in claim 7, wherein said container means includes a drawer having an opening for inserting said plurality of foreign objects therethrough; wherein said enclosing means is an elongated housing which at least partially covers said drawer, said elongated housing having an open end and a closed end, the closed end having a hole; and wherein said motivating means is attached to said elongated housing and includes a rod which passes through the hole of the closed end of said elongated housing, the rod attached to said drawer for moving said drawer between a closed position and an open position, said elongated housing substantially covering the opening of said drawer in the closed position and at least partially uncovering the opening of said drawer in the open position.

9. The apparatus as recited in claim 8, wherein said motivating means includes driving means for driving the rod, energizing means for energizing the driving means, and remote selection means for selectively energizing the driving means.

10. The apparatus as recited in claim 8, wherein said motivating means includes double acting pneumatic cylinder means for pushing and pulling the rod; a first air line which is selectively pressurized by a first remote valve for energizing the double acting pneumatic cylinder means in order to push the rod and open said drawer; and a second air line which is selectively pressurized by a second remote valve for reverse energizing the double acting pneumatic cylinder means in order to pull the rod and close said drawer.

11. The apparatus as recited in claim 3 wherein said guide means is a guide tube having a first end which protrudes through the handhole and having a second end on the tube sheet, the first end and the second end both having an L-shape, a plane of the first end being generally perpendicular to a plane of the second end.

12. An apparatus for use with a search and retrieval device for searching and retrieving a plurality of foreign objects within a heat exchanger, said apparatus for insertion into said heat exchanger and comprising:

closable container means for containing said plurality of foreign objects which are retrieved by said search and retrieval device within said heat exchanger, said closable container means having a closable opening for inserting said plurality of foreign objects therethrough and for substantially enclosing said plurality of foreign objects within said closable container means; and moving means for moving said closable container means within said heat exchanger.

13. The apparatus as recited in claim 12, wherein said closable container means includes a container having an elongated barrier which telescopes with said container, and wherein said closable container means also includes motivating means for telescoping said container and said elongated barrier between a closed position and an open position, said elongated barrier substantially blocking the closable opening of said container in the closed position and at least partially revealing the closable opening of said container in the open position.

14. The apparatus as recited in claim 13, wherein said elongated barrier is a generally cylindrical tube, and wherein said container is a generally cylindrical container, the generally cylindrical tube substantially closing the closable opening of the generally cylindrical container in the closed position, in order to grasp one of said plurality of foreign objects between the generally cylindrical tube and the generally cylindrical container.

15. The apparatus as recited in claim 13, wherein said heat exchanger includes a handhole; wherein said moving means includes remote snake means attached to said motivating means for pushing and pulling said container; and wherein said motivating means includes a rod attached to said container for moving said container; double acting pneumatic cylinder means for pushing and pulling the rod; a first air line which is selectively pressurized by a first remote valve for energizing the double acting pneumatic cylinder means in order to push the rod and open said container; and a second air line which is selectively pressurized by a second remote valve for reverse energizing the double acting pneumatic cylinder means in order to pull the rod and close said container.

* * * * *